United States Patent [19]

Williams

[11] 4,412,616

[45] Nov. 1, 1983

[54] MULTICOMPARTMENT EQUIPMENT CASE AND COVER

[75] Inventor: Paul M. Williams, Minneapolis, Minn.

[73] Assignee: Williams Sound Corporation, Eden Prairie, Minn.

[21] Appl. No.: 434,221

[22] Filed: Oct. 14, 1982

[51] Int. Cl.[3] ..... B65D 51/18

[52] U.S. Cl. ..... 206/333; 220/255; 220/22; 220/329

[58] Field of Search ..... 206/328, 333; 220/255, 220/22, 20, 329, 306

[56] References Cited

U.S. PATENT DOCUMENTS

| | | | |
|---|---|---|---|
| 414,702 | 11/1889 | Grim | 206/92 |
| 3,614,136 | 10/1971 | Dent | 280/500 |
| 4,082,391 | 4/1978 | Turner | 312/314 |

*Primary Examiner*—Joseph Man-Fu Moy

[57] ABSTRACT

A multicompartment equipment case and cover having a plurality of compartments, each having an access opening and a cover member having a plurality of segments progressively, hingedly attached one to another and configured to coact with corresponding access openings for the compartments and including latching means for releasably disposing corresponding segments on corresponding compartments.

4 Claims, 6 Drawing Figures

MULTICOMPARTMENT EQUIPMENT CASE AND COVER

BACKGROUND OF THE INVENTION

1. Field of the Invention

This invention relates generally to equipment cases and is more particularly directed to a multicompartment equipment case having a plurality of access openings and including a cover formed as a unit and including a plurality of segments for releasable attachment to each of the compartments of the case.

Briefly, my invention may be utilized in a form of equipment case in which a plurality of individual compartments are so arranged and designated as to preferably require a designated priority of access to the individual compartments. For example, in the illustrated embodiments of this specification of my invention, a two compartment equipment case is designed to provide one compartment having an electronic device or apparatus requiring only periodic maintenance while a second compartment is designed to house batteries, or the like, as a power supply for the electronic apparatus. Needless to say, the batteries or other consumable power supply, may require frequent replacement. A cover is provided that has individual sections shaped to cover the individual compartments and the sections are interconnected by suitable hinges so as to provide for opening in a priority succession whereby the segment for the battery compartment may be opened first and the segment for the electronic apparatus compartment may be opened only after the battery compartment is in an open position. The entire cover may be movably affixed, or hinged, to the remainder of the case at the location of the last to be opened segment of the assemblage.

2. Prior Art

The following prior art was noted in the course of a preliminary search based upon the disclosure of this application:

| U.S. Pat. No. | Inventor | Issued |
|---|---|---|
| 3,217,949 | Davis | 11/16/65 |
| 3,469,732 | Foster | 9/30/69 |
| 3,542,235 | Hidding | 11/24/70 |
| 3,580,650 | Morris | 5/25/71 |

All of the above patents are directed to closures of one form or another. Of the above patents, the Morris U.S. Pat. No. 3,580,650 for CABINET STRUCTURE is directed to an earlier cabinet having an inner case and an outer case, each of them operable independently and separately, but connected together in a hinged fashion so that one case is closed after equipment has been deposited therein and then the second case is used to form a case for the first case in, for example, a telescoping, box-within-a-box configuration.

BRIEF SUMMARY OF THE INVENTION

As will be described in greater detail below, my invention comprises a hollow casing that is divided into a number of compartments, each having an access opening for the installation, removal or servicing of devices disposed in each of said compartments. A cover member is provided with a plurality of segments, each of like corresponding complementary dimension with respect to each of the corresponding access openings into the several compartments of the case. The cover member is configured to be hingedly attached to the casing adjacent one of the access openings and the remainder of the segments of the cover member are hingedly disposed on another segment in such a manner that the cover may be applied to successive compartments with each segment in latching, releasable engagement with suitable means provided on the individual segments and the individual access openings so that when fully applied in the manner to be described below, each of the access openings is fitted with a cover and the combination provides a closed container for all of the equipment and apparatus disposed in the several individual compartments.

In a typical application of my invention, a compartmented case may be conveniently molded of suitable plastic material together with a segmented cover, the segments of which are hingedly connected, one with respect to the other, by resilient plastic material with one of the segments being by resilient plastic material with one of the segments being connected to the casing itself by a similarly formed hinge. The latching means provided for the individual segments are designed to be normally and conveniently operated in sequence such that the latching means may be opened with increasing difficulty as the individual segments are unlatched from their corresponding compartments so as to establish a priority in the order of opening of the specifically configured succession of progression of segments on the cover which might normally, in a typical application, provide for an initial access to a compartment for replaceable or frequently used materials and the latches on the successive segments being provided with suitable latching means that may be opened with progressively increased difficulty so as to provide for a form of limited access to rarely used compartments which may contain components requiring some degree of security.

Other objects and advantages of my invention will become apparent from a consideration of the appended specification, claims and drawings.

DESCRIPTION OF THE ILLUSTRATED EMBODIMENT

Figure 1:
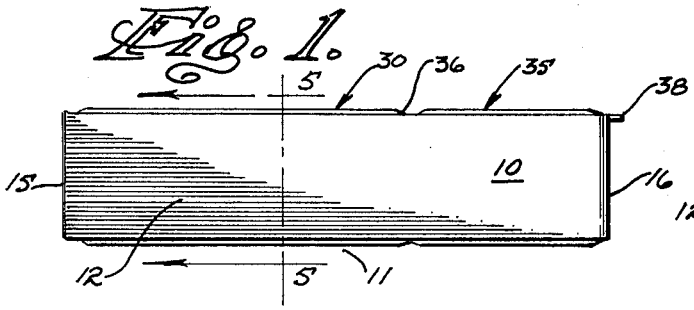
FIG. 1 is a side elevational view of an equipment case embodying the principles of my invention.
Figure 2:
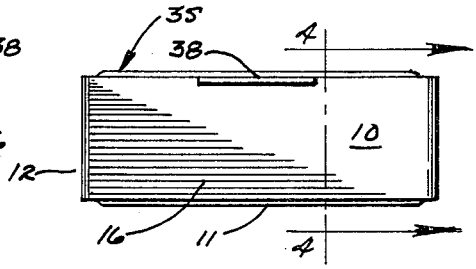
FIG. 2 is an end elevational view of the case illustrated in FIG. 1.
Figure 3:
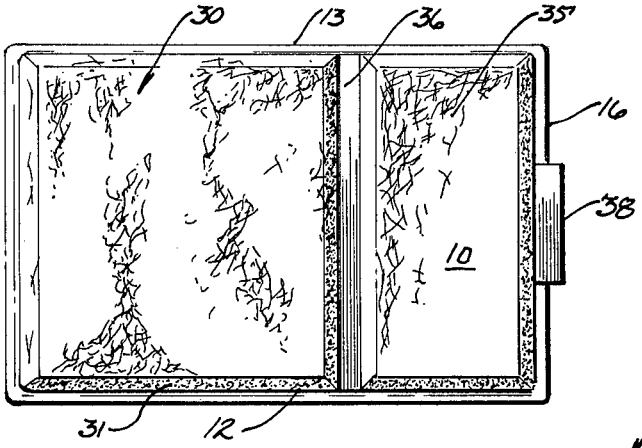
FIG. 3 is a top plan view thereof.
Figure 4:
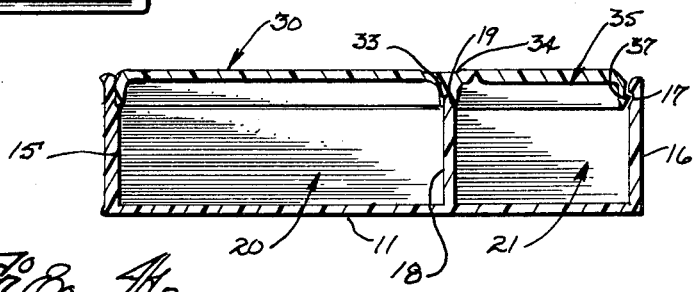
FIG. 4 is a sectional view taken along section line 4—4 on FIG. 2 of the drawings.
Figure 5:
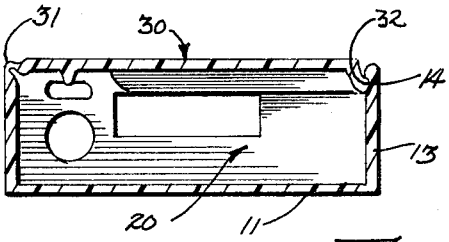
FIG. 5 is a sectional view taken along section line 5—5 on FIG. 1 of the drawings.
Figure 6:
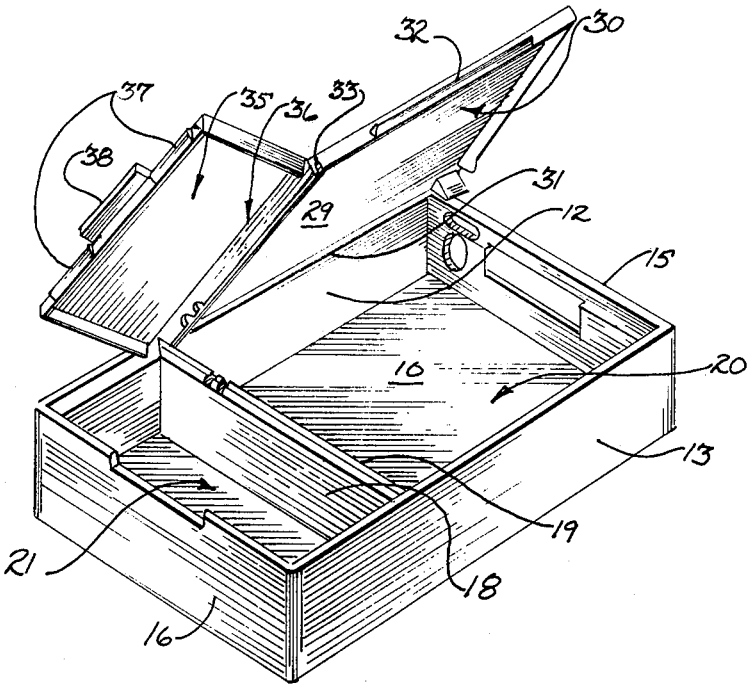
FIG. 6 is a top perspective view of my multicompartment equipment case showing the cover in an opened position.

Referring to the drawings, my multicompartment equipment case and cover is indicated generally by reference character 10. Case 10 includes a bottom 11, side portions 12 and 13, including a latching recess 14 disposed on side member 13 and end members 15 and 16 including similar latching recesses 17 on end member 16. Case 10 is further provided with an intermediate wall 18, having a rounded top 19, so as to divide case 10 into compartments 20 and 21, each having a latching recess for receiving a corresponding latch on a cover member to be described below.

A multisegment cover member is indicated generally by reference character 29 and includes a first segment 30 that is configured and shaped to coact with the top opening of compartment 20 and is hingedly attached along one side to the top of a portion of sidewall 12 by hinge member 31 and includes a latch member 32 and a groove 33 for coaction with the rounded top 19 on interior wall 18; and a further segment member 35 that is shaped and configured to coact with the top access opening of compartment 21 and includes a hinge portion 36 that is attached to one end of segment 30, and a pair of latches 37 and a lift tab 38.

The entire multicompartment case and cover may conveniently be fabricated of suitable resilient plastic material to provide the "living hinge" portions 31 and 36 on cover 29 as well as latching recesses 14 and 17 in sidewall 13 and end wall 16 and other features as may be desirable dependent upon the equipment to be placed in the several compartments of the case. It may also be noted that hinge members 31 and 36 are illustrated as having a non-parallel relationship.

Further, in the illustrated embodiment, latch member 32 on cover 30 and groove 14 on side wall 13 are created and intended to require a greater opening or unlatching force than that obtained from latches 37 and groove 17 on cover member segment 35 and end wall 16 respectively. In one application of the preferred embodiment, compartment 21 is intended to receive and house batteries that require periodic replacement while compartment 20 is utilized to house suitable electronic equipment such as radio receivers and amplifiers which may require very infrequent servicing and it is not intended that the user of the equipment installed in compartment 20 may or need have access to such equipment. The designed characteristics of the latch for cover segment 35 provides that it may be opened with considerably lesser resistance than the latch for cover segment 30 so that a priority of operation is established which might logically be followed by one using the apparatus within case 10 by first opening cover segment 35 to allow access to the batteries and normally proceeding no further because of the sequential operation of the successive segments of cover 29 and the difference in the characteristics of the latching means as between cover segment 35 and cover segment 30.

Further, the location of latch member 32 and groove 14 on side wall 13 are completely hidden and invisible when cover 30 is closed. It is possible to open and close cover member segment 35 without ever having the realization that cover member 30 is also hinged. The apparatus thereby provides some measure of security for the contents within the compartment closed by cover 30.

OPERATION OF THE ILLUSTRATED EMBODIMENT

In applying the principles of my invention to a given application, as illustrated in the drawings, one skilled in the art to which my invention pertains, will typically assembly the equipment to be housed and maintained in a casing. Upon determination of the number of compartments, considering the size of the equipment to be installed, and the meets and bounds of the individual compartments determined, a person skilled in the art in practicing my invention might typically arrive at a case design having all of the access openings to the individual compartments disposed in a single plane, although other configurations are readily possible. The disposition of the compartments, one with respect to the other, is further "prioritized" and the individual segments for the cover are determined with respect to the priority to be established by the latching means and the hinged connection intermediate the individual segments of the cover 29 with respect to each other and to case 10. With careful planning, the entire assembly may be injection molded in a one piece article of suitable plastic material which may typically include the properties of resilience for hinge portions 31 and 36.

I claim:

1. In an equipment case of the class providing multiple compartments to which periodic access is necessary, the combination, comprising:

a hollow one-piece plastic case including a plurality of compartments, each having an access opening, said access opening including means for latchable receiving a latch on a cover member therefore; and a foldable one-piece plastic cover member including a like plurality of segments shaped and configured to coact with corresponding access openings in said case, and including a latch disposed and shaped to coact with corresponding ones of said means for latchably receiving said latch, one of said segments being hingedly attached to said case by resilient plastic material bridging to said case along one of said access openings and another of said segments being hingedly attached to said one segment by resilient plastic material along an edge of said one segment orthogonal to said case hinged attachment, only said last-identified segment having a lift tab attached thereto for unlatching said segment, thereby to require preferred sequential unlatching and latching of said segments.

2. The apparatus of claim 1 in which the access openings for the compartments are formed in a plane.

3. The apparatus of claim 1 in which the axes of the hinges for alternate segments are non-parallel.

4. The apparatus of claim 1 in which the means for latchably receiving the latches and the latches on one of said access openings and the corresponding cover segment exhibit dissimilar characteristics with respect to another access opening and corresponding cover member segment.

* * * * *